US006745536B2

(12) United States Patent
Tallman et al.

(10) Patent No.: US 6,745,536 B2
(45) Date of Patent: Jun. 8, 2004

(54) CEILING TILE SUPPORT SYSTEM AND METHOD

(76) Inventors: Van S. Tallman, 25590 142nd St., Zimmerman, MN (US) 55398; Brooke L. Peterson, 8335 Upper 138th Ct., Apple Valley, MN (US) 55124

( * ) Notice: Subject to any disclaimer, the term of this patent is extended or adjusted under 35 U.S.C. 154(b) by 0 days.

(21) Appl. No.: 10/314,526

(22) Filed: Dec. 9, 2002

(65) Prior Publication Data

US 2003/0106276 A1 Jun. 12, 2003

Related U.S. Application Data

(60) Provisional application No. 60/339,136, filed on Dec. 7, 2001.

(51) Int. Cl.[7] ..... E04B 9/24

(52) U.S. Cl. ..... 52/506.06; 52/506.07

(58) Field of Search ..... 52/506.06, 506.07, 52/506.08, 745.06, 747.1, 770, 772, DIG. 8

(56) References Cited

U.S. PATENT DOCUMENTS

| | | | | | |
|---|---|---|---|---|---|
| 1,586,053 | A | * | 5/1926 | Snyder | 52/737.6 |
| 1,927,442 | A | * | 9/1933 | Laufle | 52/635 |
| 2,167,836 | A | * | 8/1939 | Greulich | 52/376 |
| 3,027,984 | A | * | 4/1962 | Dunn | 160/392 |
| 3,046,620 | A | * | 7/1962 | Tvorik et al. | 52/714 |
| 3,263,388 | A | * | 8/1966 | Bogert | 52/665 |
| 3,809,358 | A | * | 5/1974 | Hazeley | 248/317 |
| 3,899,152 | A | * | 8/1975 | Avery | 249/18 |
| 4,144,690 | A | * | 3/1979 | Avery | 52/376 |
| 4,281,497 | A | * | 8/1981 | Luotonen et al. | 52/730.7 |
| 4,624,088 | A | * | 11/1986 | Arent | 52/506.07 |
| 4,910,933 | A | * | 3/1990 | Schwarzfeller et al. | 256/47 |
| 4,913,594 | A | * | 4/1990 | Sigourney | 405/285 |
| 5,152,114 | A | * | 10/1992 | Beazley et al. | 52/264 |
| 5,265,393 | A | * | 11/1993 | Bischel et al. | 52/461 |
| 5,611,185 | A | * | 3/1997 | Wilz | 52/506.07 |
| 5,822,941 | A | | 10/1998 | Kinsella | 52/506.05 |
| 5,893,250 | A | * | 4/1999 | Benvenuto et al. | 52/506.08 |
| 6,035,598 | A | | 3/2000 | Sukolics et al. | 52/506.08 |
| 6,131,361 | A | | 10/2000 | Murphy | 52/712 |
| 6,145,264 | A | | 11/2000 | Dallaire | 52/526.05 |
| 6,205,732 | B1 | * | 3/2001 | Rebman | 52/506.07 |
| 6,286,285 | B1 | | 9/2001 | Martell | 52/712 |
| 6,374,570 | B1 | * | 4/2002 | McKague, Jr. | 57/762 |

* cited by examiner

*Primary Examiner*—Leslie A. Braun
*Assistant Examiner*—Jon Szumny
(74) *Attorney, Agent, or Firm*—Larkin Hoffman Daly & Lindgren, Ltd.; Thomas J. Oppold, Esq.

(57) ABSTRACT

A tile support structure and method for finishing the ceiling of a building. The support structure includes a plurality of adjacently spaced elongated bracket members secured to a building's overhead framing members and a plurality of adjacently spaced elongated cross members disposed transversely to and supported by the adjacently spaced bracket members thereby defining a supporting grid for supporting a plurality of tiles.

6 Claims, 2 Drawing Sheets

CEILING TILE SUPPORT SYSTEM AND METHOD

CROSS REFERENCE TO RELATED APPLICATIONS

Priority is claimed under 35 U.S.C. §119(e) to U.S. Provisional Application Serial No. 60/339,136 having a filing date of Dec. 7, 2001.

BACKGROUND OF THE INVENTION

1. Field of the Invention

The present invention relates generally to the field of building construction and more particularly to the finishing of interior ceiling spaces of buildings.

2. Description of the Related Art

Most interior spaces of homes and many commercial buildings and offices are finished by attaching drywall, also known as sheet rock or gypsum board, directly to the buildings framing members using drywall screws or nails. Drywall is typically provided in 4 ft.×8 ft or 4 ft.×12 ft. sheets or panels with thicknesses ranging from ¼ inch to ¾ inch. Accordingly, due to their weight and size these panels generally require more than one person to install or require the use of a drywall lift to raise the panel and hold it in place until it can be attached to the framing members. After being attached to the framing members, the joints between the drywall sheets are generally taped with drywall tape and then "mudded" with joint compound in order to hide or cover the joints for a smooth, finished appearance. Typically, two to three layers of joint compound must be applied in order to adequately hide the joint and obtain a smooth finish. Each layer of compound generally requires twelve to twenty-four hours of drying time and then must be sanded before the next layer of joint compound can be applied. The final layer of joint compound must also be sanded after it is dry to obtain a smooth finish.

Accordingly, it should be appreciated that the conventional method of installing drywall is a very labor intensive, time consuming and expensive process, not only due to the amount of time and skill required to properly hang the drywall, but also due to the amount of cleanup required to remove the dust and debris accumulated from the joint preparation process.

Others have attempted to device tools and methods to overcome and address some of the difficulties and disadvantages associated with conventional drywall installation. For example, U.S. Pat. No. 6,131,361 discloses a bracket used to temporarily support sheets of drywall during installation. U.S. Pat. No. 5,822,941 discloses a connector which is foldable and which releasably engages a panel of drywall and the like and secures the drywall to the framing members. U.S. Pat. No. 6,286,285 discloses a wall bracket for aiding the attachment of drywall panels. The bracket is connected to the wall adjacent the ceiling and has a shelf area to support the drywall panels adjacent the wall.

In addition to use of drywall for attaching directly to a building's framing members, suspended ceilings or "drop" ceilings are also used for finishing of interior ceilings. Suspended ceilings typically involve a series of wires which are fixed to the building's overhead framing or mechanical components. A lower end of the wires connects to and suspends the suspended ceiling grid which support the ceiling tiles. Installing the suspended ceiling grid such that it is level with uniform grid spacings is often difficult to achieve requiring precise measurements and typically requires the employment of leveling tools, chalk lines and plumb bobs. Suspended ceilings offer certain advantages over drywall, such as lower cost, less cleanup, and the ability to remove the individual tiles from the supporting grid in the event a tile becomes damaged or in order to gain access to the overhead structure or mechanical components of the building. However the supporting grid and individual ceiling tiles are typically too lightweight to support insulation. Also, the tiles are easily damaged, and offer little or no protection or resistance to fire or noise.

While the above identified methods for finishing interior spaces of buildings may be suitable for their intended purposes, there remains a need in the industry for a system that provides the features and advantages of suspended ceilings while at the same time providing the features and advantages of drywall and like materials.

SUMMARY OF THE INVENTION

A ceiling tile support system and method for finishing interior ceiling spaces of a building. The ceiling tile support system comprises a plurality of adjacently spaced elongated bracket members secured to a building's overhead framing members. The system further comprises a plurality of adjacently spaced elongated cross members disposed transversely to and supported by the adjacently spaced bracket members thereby defining a supporting grid for receiving and supporting the ceiling tiles.

The ceiling tiles comprising the system of the present invention may be drywall, conventional cellular ceiling tiles, wood, glass, composites, insulating materials or any other materials. Additionally, the tiles may be lighting fixtures, vent fixtures, speakers, smoke or fire detectors or any other materials or fixtures which may be supported by a grid.

To the accomplishment of the above objects, features and advantages, this invention may be embodied in the forms illustrated in the accompanying drawings, attention being called to the fact, however, that the drawings are illustrative only, and the changes may be made in the specific form illustrated and described within the scope of the appended claims.

DETAILED DESCRIPTION OF THE INVENTION

Figure 1:
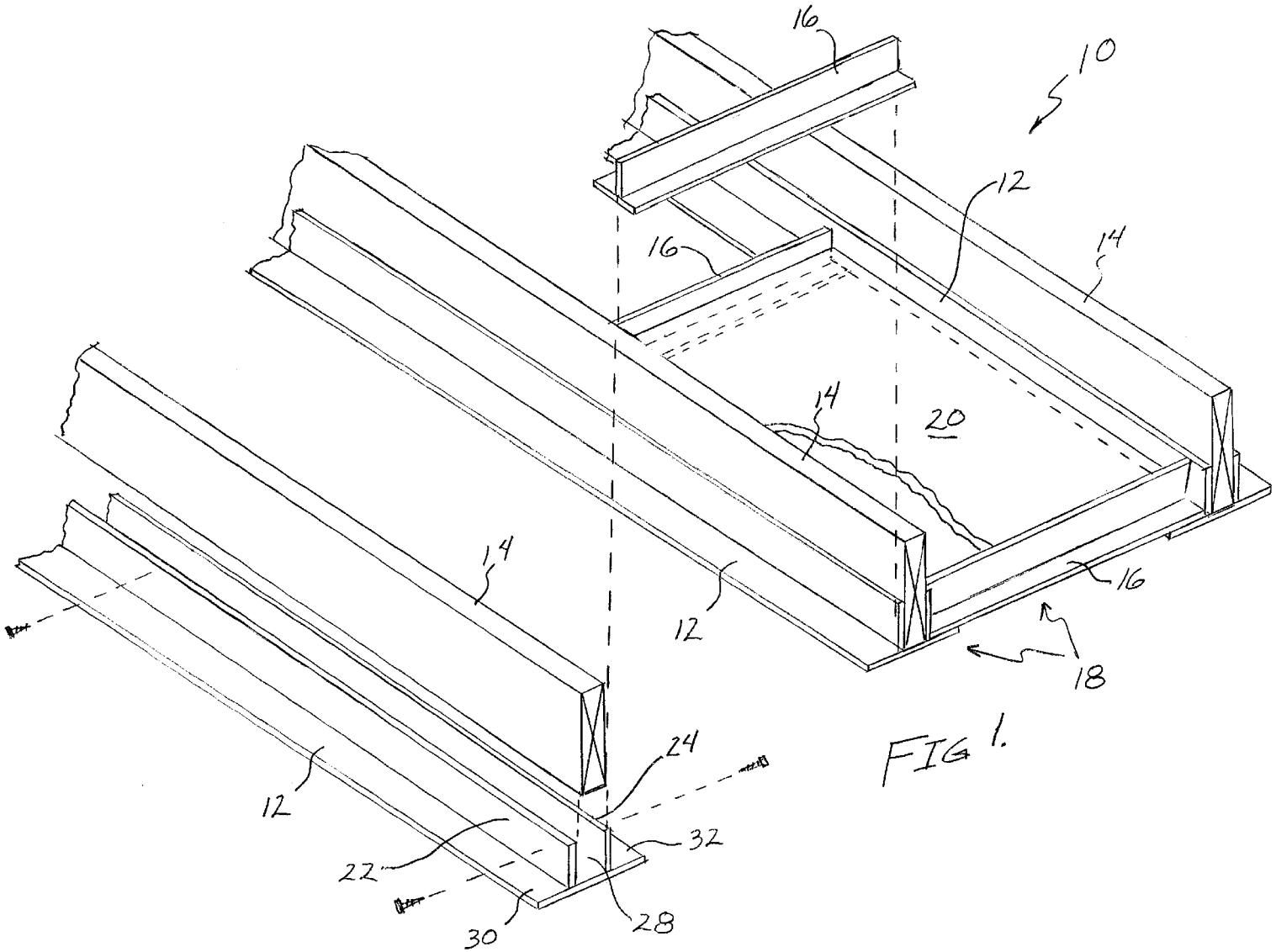
FIG. 1 is a perspective view of the ceiling tile support grid of the present invention comprising the preferred bracket members attached to a building's overhead framing members and the preferred cross-members supported by the bracket members.

With reference to FIG. 1, the ceiling tile support system 10 of the present invention comprises a plurality of adjacently spaced elongated bracket members 12 secured to a building's overhead framing members 14. The system 10 further comprises a plurality of adjacently spaced elongated cross members 16 disposed transversely to and supported by the adjacently spaced bracket members 12 thereby defining a supporting grid 18. The system further comprises a plurality of tiles 20 supported by the grid 18.

As used herein the term "tile" 20 should be understood as meaning any element to be supported by the grid 18, including standard drywall, increased thickness drywall (also sometimes known in the trade as fire rock), conventional cellular ceiling tiles, wood, glass, composites, insulating materials or any other materials. Additionally, the term tile 20 should be understood as meaning any lighting fixtures, vent fixtures, speakers, smoke or fire detectors or any other material or fixture that may be supported by the grid 18.

Figure 2:
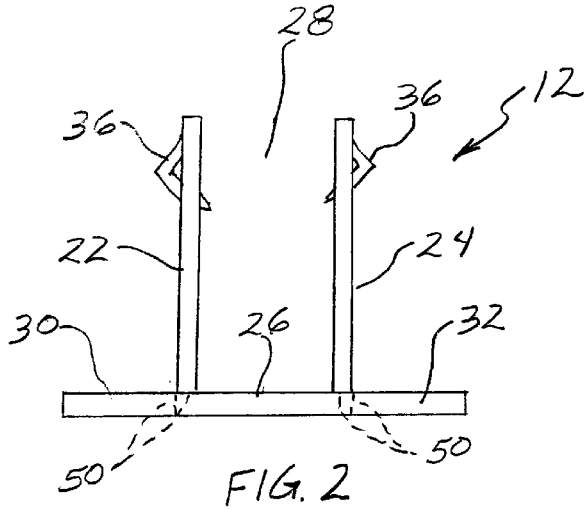
FIG. 2 is an end view of the preferred bracket member of the ceiling tile support system of the present invention.
Figure 3:
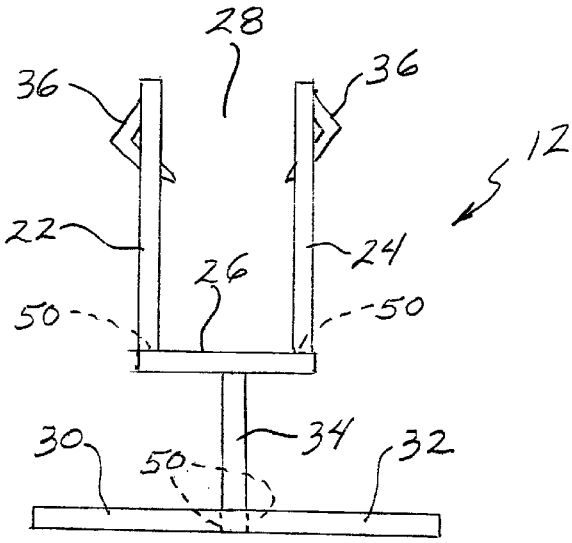
FIG. 3 is an end view an alternative embodiment to the bracket member.

Referring now to FIG. 2, a detailed view of the preferred bracket member 12 is shown. The preferred bracket member 12 preferably includes first and second legs 22, 24 spaced a predetermined distance to readily receive the building's overhead framing members 14. Depending on the framing members used in the construction of the building, the space between the legs 22, 24 may vary. For conventional homes constructed of dimensional lumber, in which the typical overhead framing members are constructed using 2-X dimensional wood members, the preferred spacing of the legs would be 1⅝ to 1¾ inches for receiving the 1½ inch wide framing member 14. The legs 22, 24 are preferably joined at one end by a web 26 thereby forming a channel 28 in which the building framing member is received. Projecting outwardly from the legs are first and second flanges 30, 32. The opposing flanges 30, 32 of adjacently spaced bracket members 12 provide a shelf for receiving the tiles 20 as shown in FIG. 1. In an alternative embodiment, as illustrated in FIG. 3, the bracket members may include a vertical web 34 projecting downwardly from the web 26 at the base of the channel 28 from which the flanges 30, 32 may extend.

The legs 22, 24 of the bracket member 12 preferably include a series of barbs 36 spaced along the longitudinal axis of the bracket members. These barbs 36 are preferably similar to the barbs found on conventional joist hanger brackets which may be pounded into the face of the overhead framing members 14 to assist the hanging and placement of the bracket members 12 during initial installation. Referring again to FIG. 1, once the bracket members 12 are properly installed at predetermined adjacent spacings and at a uniform elevation, the bracket members 12 are finally secured in place to the framing members by nails, screws, or the like as shown in FIG. 1.

Figure 4:
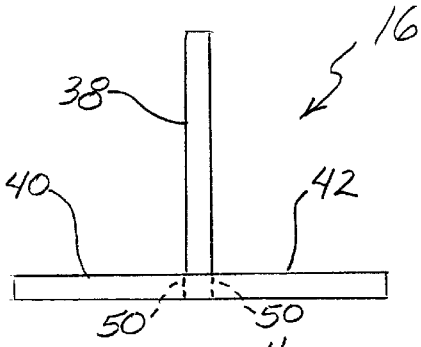
FIG. 4 is an end view of the preferred cross member.

Referring now to FIG. 4, a detailed view of the preferred cross member 16 is shown. The preferred cross member 16, is T-shaped and includes a vertical leg 38 and opposing, outwardly extending first and second flanges 40, 42. As illustrated in FIG. 1, similar to the flanges of the bracket member 12, the opposing flanges of the adjacently spaced cross members 16 form a shelf upon which the edges of the tiles 20 are supported.

When installing the system 10 of the present invention on a ceiling in a typical home, for example, the joists or beams comprising the overhead building frame members 14 will be in a substantially horizontal plane such that the web 26 may be placed against the bottom of the framing member 14 as shown in FIG. 2. However, the legs 22, 24 of the bracket member 12 for receiving the building member 14 are preferably of sufficient length such that the web 26 may be adjustably spaced from the bottom portion of the frame member 14 to accommodate any inconsistencies in the elevation of the framing members due to poor construction or due to any noticeable camber, warping or defects in the overhead framing members 14, thereby ensuring that finished elevation of the grid 18 and tiles 20 are substantially uniformly horizontal.

Next the cross members 16 are installed. Preferably the cross members 16 are prefabricated to standard lengths in multiples of the conventional center-to-center (c-c) spacings of the building's framing members 14 (i.e., 12 inch c-c; 16 inch c-c, or 24 inch c-c) or multiples thereof (i.e., 24, 32 or 48 inches, etc.). Additionally, the cross members 16 may be fabricated in lengths, and cut to the proper length on the job site. The cross-members 16 are preferably spaced to provide a grid 18 of substantially uniform or equal openings across the room. However, any desired spacing may be used. The flanges 40, 42 of the cross members 16 preferably simply rest on top of the opposing flanges of the adjacently spaced bracket members 12, but the flanges 40, 42 may also be adhered or otherwise connected to the opposing flanges 30, 32 of the bracket members 12.

Once the bracket members 12 and cross members 16 are installed, the tiles 20 are installed. The tiles 20 are preferably sized such that the edges of the tiles are supported by overlapping or resting on the opposing flanges defining each opening of the grid 18. To install the tiles 20 within the openings of the grid 18, the tiles 20 are tilted while being elevated above the opposing flanges. The upper surface of the flanges upon which the edges of the tiles 20 are supported may include an abrasive, an adhesive layer, two-sided adhesive tape, anti-skid paint material, hook and loop fasteners or any other securing means.

As identified above light fixtures, vent fixtures, speaker fixtures, or any other fixture may comprise the tiles 20. Such tiles 20 may extend across an entire opening of the grid 18, or the fixture may be first affixed to a tile 20 and then the tile and fixture installed together. In another alternative embodiment, additional cross members 16 may be spaced transversely across the previously installed cross members 16 thereby defining a smaller fixture opening within the grid array.

It should be appreciated, that in some applications it may be desirable to remove one of the legs 22, 24 of the bracket members 12, or one of the flanges of the bracket members 12 or cross members 16. For example, when the framing member 14 is near a wall, there may not be sufficient space for a leg or flange of one of the members 12, 16. In such a situation, the undesired leg or flange may be cut or broken off as indicated in FIGS. 2 and 4 along broken lines 50. In an alternative embodiment, to aid in the removal of a portion of the bracket and cross member 12, 16, the legs and flanges may be scored or crimped during the fabrication process along lines 50 such that they may be easily broken off without requiring cutting tools.

The bracket and cross members 12, 16 are preferably fabricated by an extrusion process in relatively long lengths to minimized seams that may be visible between abutting ends of the bracket members 12. However, it should be appreciated that any suitable fabrication method may be used. Furthermore, the members 12, 16 may be made from any suitably rigid or semi-rigid material, including metal, plastic, wood, composite materials, etc. Additionally any color, pattern or design or combinations of color, patterns or design may be used to bring about an aesthetic appeal or outcome. Texture may be incorporated into the original article of manufacture or may be added subsequent to installation.

It should be appreciated that an interior space finished according to the present invention does not require additional any additional joint preparation generally required for conventional drywall installations, for example. Thus, no taping and mudding steps are required, although if desired, mudding and taping over the bracket and cross members may be performed if one does not desire the grid 18 to be exposed. Additionally, it should be appreciated that the system 10 of the present invention allows the individual tiles 20 to be removed, thus allowing access to the space between the tiles and the building structure for inspection, storage, routing wiring or conduit and the like, to install lighting, speakers, vents, or to add or increase insulation. Once installed according to the present invention, such surfaces may be optionally painted, coated, covered or textured as is known in the art, and ornamental artwork, wall hangings, pictures, mirrors, wall fixtures, electrical boxes and the like may be installed.

Although only certain exemplary embodiments of the invention have been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A method of finishing a ceiling of a building having adjacently spaced overhead framing members, said method comprising the steps of:

a. providing a plurality of bracket members, each said bracket member having spaced first and second legs defining a channel therebetween, said elongate bracket members further having first and second flanges extending outwardly from each said leg;

b. providing a plurality of elongated cross members having a predetermined length, each said elongated cross member having a vertical leg and first and second flanges extending outwardly from said vertical leg;

c. attaching said plurality of bracket members to said adjacently spaced overhead framing members wherein said overhead framing members are received within said channel between said spaced first and second legs;

d. placing said plurality of cross members in adjacent spaced relation across said adjacently spaced elongated bracket members such that each end of said cross member is supported by said opposing flanges of said adjacently spaced elongated main bracket members, wherein said flanges of said adjacently spaced elongated bracket members and said adjacently spaced transverse cross members form a supporting grid of openings;

e. providing a plurality of tiles having sides with lengths greater than a distance between opposing flanges of adjacently spaced bracket members and cross members but less than a distance between opposing leg members of said adjacently spaced bracket members and cross members;

f. placing said tiles within said openings of said support grid with said sides of said tiles supported by said opposing flanges of said adjacently spaced bracket members and cross members.

2. The method of claim 1 wherein said tiles comprise drywall.

3. The method of claim 1 wherein said tiles comprise wood.

4. The method of claim 1 wherein said tiles comprise cellular material.

5. The method of claim 1 wherein said tiles comprise composite material.

6. The method of claim 1 wherein said tiles comprise fixtures.

* * * * *